US009126429B2

(12) United States Patent
Kitaoka et al.

(10) Patent No.: US 9,126,429 B2
(45) Date of Patent: Sep. 8, 2015

(54) IMAGE FORMING APPARATUS AND TREATMENT LIQUID APPLICATION DEVICE

(75) Inventors: Satoshi Kitaoka, Kanagawa (JP); Shinji Imoto, Tokyo (JP); Hiroyoshi Komaba, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 423 days.

(21) Appl. No.: 13/225,914

(22) Filed: Sep. 6, 2011

(65) Prior Publication Data

US 2012/0060754 A1 Mar. 15, 2012

(30) Foreign Application Priority Data

Sep. 11, 2010 (JP) ..... 2010-203808

(51) Int. Cl.
*B05C 11/02* (2006.01)
*B41J 11/00* (2006.01)
*B05C 1/08* (2006.01)

(52) U.S. Cl.
CPC ..... *B41J 11/0015* (2013.01); *B05C 1/083* (2013.01); *B05C 1/0834* (2013.01)

(58) Field of Classification Search
CPC .... B05C 1/083; B05C 1/0834; B41J 11/0015; B41F 31/027
USPC ..... 118/256, 261, 262, 203, 413, 414, 64; 347/1, 22, 104, 105; 15/256.5, 256.51, 15/256.52; 399/343–360, 249, 1, 341; 101/148, 218, 247
See application file for complete search history.

(56) References Cited

U.S. PATENT DOCUMENTS

| | | | | | |
|---|---|---|---|---|---|
| 2,528,657 | A | * | 11/1950 | Hobe, Sr. | 401/218 |
| 3,897,726 | A | * | 8/1975 | Junghans | 101/425 |
| 3,973,516 | A | * | 8/1976 | Minkow | 118/262 |
| 4,066,017 | A | * | 1/1978 | Garcowski et al. | 101/425 |
| 5,766,350 | A | * | 6/1998 | Becker et al. | 118/249 |
| 5,978,630 | A | * | 11/1999 | Chang et al. | 399/249 |
| 2007/0126836 | A1 | * | 6/2007 | Masuyama et al. | 347/103 |

(Continued)

FOREIGN PATENT DOCUMENTS

| | | |
|---|---|---|
| JP | 64-85766 | 3/1989 |
| JP | 07-156538 | 6/1995 |

(Continued)

OTHER PUBLICATIONS

U.S. Appl. No. 13/045,089 of Satoshi Kitaoka et al., filed Mar. 11, 2011.

(Continued)

*Primary Examiner* — Laura Edwards
(74) *Attorney, Agent, or Firm* — Cooper & Dunham LLP

(57) ABSTRACT

An image forming apparatus includes an image forming unit to form an image on a recording medium and a treatment-liquid application device to apply a treatment liquid to the medium. The application device includes a conveyance roller to convey the medium, an application roller to apply the liquid to the medium, a squeeze roller to spread the liquid on the application roller to form a thin layer of the liquid on the application roller, and a housing member to retain the application roller and the squeeze roller within the housing member and cover outer circumferential surfaces of the application roller and the squeeze roller. The housing member has an opening to contact the application roller with the conveyance roller through the opening and a storage portion to store the liquid. The housing member is rotatable while retaining the application roller and the conveyance roller within the housing member.

11 Claims, 14 Drawing Sheets

(56) References Cited

U.S. PATENT DOCUMENTS

| | | | | |
|---|---|---|---|---|
| 2007/0212128 | A1* | 9/2007 | Asakura et al. | 399/307 |
| 2007/0212136 | A1* | 9/2007 | Asakura et al. | 399/340 |
| 2009/0067868 | A1* | 3/2009 | Arizumi et al. | 399/67 |
| 2009/0151625 | A1 | 6/2009 | Matsumoto et al. | |
| 2010/0245460 | A1 | 9/2010 | Imoto et al. | |
| 2011/0057988 | A1 | 3/2011 | Izumikawa et al. | |

FOREIGN PATENT DOCUMENTS

| | | |
|---|---|---|
| JP | 2003-205673 | 7/2003 |
| JP | 2005-138502 | 6/2005 |
| JP | 4223183 | 11/2008 |
| JP | 2009-12394 | 1/2009 |

OTHER PUBLICATIONS

U.S. Appl. No. 13/158,767 of Hiroyoshi Komaba et al., filed Jun. 13, 2011.

Japanese official action dated Mar. 11, 2014 in corresponding Japanese patent application No. 2010-203808.

Japanese official action dated Feb. 17, 2015 in corresponding Japanese Patent Application No. 2010-203808.

* cited by examiner

IMAGE FORMING APPARATUS AND TREATMENT LIQUID APPLICATION DEVICE

CROSS-REFERENCE TO RELATED APPLICATIONS

This patent application is based on and claims priority pursuant to 35 U.S.C. §119 to Japanese Patent Application No. 2010-203808, filed on Sep. 11, 2010 in the Japan Patent Office, the entire disclosure of which is hereby incorporated herein by reference in its entirety.

TECHNICAL FIELD

This disclosure relates to an image forming apparatus and a treatment-liquid application device.

DESCRIPTION OF THE BACKGROUND ART

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head (liquid-droplet ejection head) for ejecting droplets of ink. During image formation, such liquid-ejection-type image forming apparatuses eject droplets of ink or other liquid from the recording head onto a recording medium to form a desired image.

Such liquid-ejection-type image forming apparatuses fall into two main types: a serial-type image forming apparatus that forms an image by ejecting droplets from the recording head while moving the recording head in a main scanning direction of the carriage, and a line-head-type image forming apparatus that forms an image by ejecting droplets from a linear-shaped recording head held stationary in the image forming apparatus.

Such a liquid-ejection-type image forming apparatus may have image failures, such as "feathering" in which dots formed with liquid droplets blur in an jaggy shape on the recording medium and "color bleeding" in which, e.g., ink droplets of different colors mix each other at adjacent areas on the recording medium to blur color boundaries. Alternatively, such a liquid-ejection-type image forming apparatus may take a relatively long time to dry liquid droplets on a recording medium after image formation.

To cope with such failures, a pretreatment liquid may be applied by an application roller onto the recording medium before image formation so as to react ink on the recording medium to minimize bleeding. Alternatively, a pretreatment liquid may be ejected from the liquid ejection head in mist form onto the recording medium. Moreover, a treatment liquid may be applied in foam onto the recording medium.

As described above, in a case in which such a treatment liquid is applied to the recording medium, typically, a portion of a squeeze roller is immersed in the treatment liquid stored in a pan, and the squeeze roller draws up the treatment liquid to supply the treatment liquid to the application roller.

For such a configuration, however, while operation of the application device is stopped, moisture evaporates from the treatment liquid on the squeeze roller and the application roller. As a result, the treatment liquid dries and increases the viscosity, thus causing variance in the application amount of the treatment liquid when the application is resumed. To prevent such a failure, it is conceivable to initialize (restore) the condition of the treatment liquid on the application roller.

However, such initialization may adversely increase the activation time in resuming the application of the treatment liquid.

BRIEF SUMMARY

In an aspect of this disclosure, there is provided an image forming apparatus including an image forming unit and a treatment-liquid application device. The image forming unit forms an image on a recording medium. The treatment-liquid application device applies a treatment liquid to the recording medium. The treatment-liquid application device includes a conveyance roller, an application roller, a squeeze roller, and a housing member. The conveyance roller conveys the recording medium. The application roller applies the treatment liquid to the recording medium. The squeeze roller spreads the treatment liquid on the application roller to form a thin layer of the treatment liquid on the application roller. The housing member retains the application roller and the squeeze roller within the housing member and cover outer circumferential surfaces of the application roller and the squeeze roller. The housing member has an opening to contact the application roller with the conveyance roller through the opening and a storage portion to store the treatment liquid. The housing member is rotatable while retaining the application roller and the conveyance roller within the housing member.

In another aspect of this disclosure, there is provided the above-described treatment-liquid application device.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
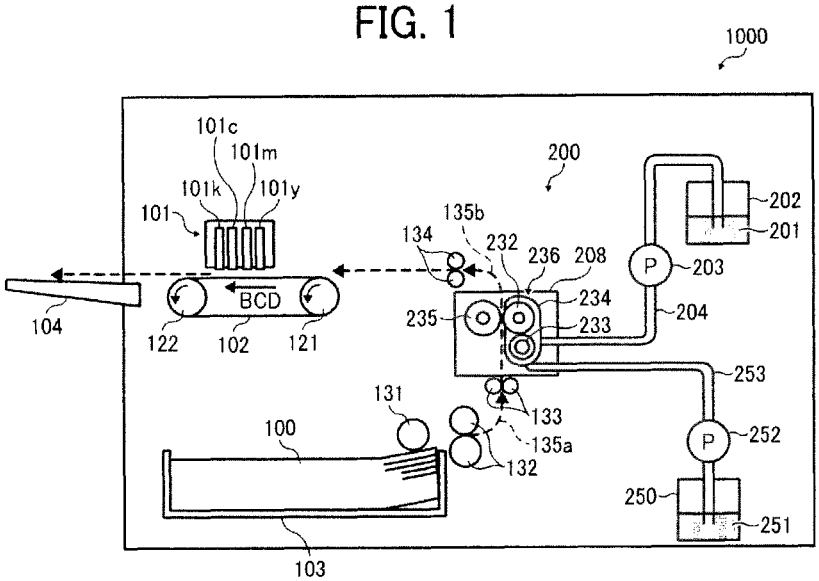
FIG. 1 is a schematic view of an image forming apparatus according to a first exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In this disclosure, the term "image forming apparatus" of liquid ejection type refers to an apparatus that ejects ink or any other liquid on a medium to form an image on the medium. The medium is made of, for example, paper, string, fiber, cloth, leather, metal, plastic, glass, timber, and ceramic. The term "image formation", which is used herein as a synonym for "image recording" and "image printing", includes providing not only meaningful images such as characters and figures but meaningless images such as patterns to the medium. The term "ink" as used herein is not limited to "ink" in a narrow sense and includes anything useable for image formation, such as recording liquid, fixing solution, liquid, and resin. The term "sheet" used herein is not limited to a sheet of paper and includes anything such as an OHP (overhead projector) sheet or a cloth sheet on which ink droplets are attached. In other words, the term "sheet" is used as a generic term including a recording medium, a recorded medium, a recording sheet, and a recording paper sheet. The term "image" used herein is not limited to a two-dimensional image and includes, for example, an image applied to a three dimensional object and a three dimensional object itself formed as a three-dimensionally molded image. Although a liquid-ejection-type image forming apparatus is described below, the term "image forming apparatus" used herein is not limited to the liquid-ejection-type image forming apparatus and may be, for example, electrophotographic image forming apparatus.

Referring now to the drawings, wherein like reference numerals designate identical or corresponding parts throughout the several views, exemplary embodiments of the present disclosure are described below.

First, an image forming apparatus according to an exemplary embodiment of this disclosure is described with reference to FIG. 1.

FIG. 1 is a schematic view of a general configuration of the image forming apparatus. The image forming apparatus 1000 includes a recording head unit 101 serving as an image forming unit to eject droplets of liquid onto a sheet 100 serving as a recording medium to form an image on the recording medium, a conveyance belt 102 to convey the sheet 100, a sheet feed tray 103 to store the sheet 100, and a treatment-liquid application device 200 disposed upstream from the recording head unit 101 in a sheet transport direction to apply the treatment liquid onto the sheet 100 serving as an application target to which the treatment liquid is applied.

The recording head unit 101 includes at least one line-type liquid ejection head. Each liquid ejection head has at least one nozzle row including multiple nozzles to eject ink droplets through. In each nozzle row, the multiple nozzles are arrayed within a range corresponding to, e.g., a maximum width of available recording media. As illustrated in FIG. 1, the recording head unit 101 includes, for example, recording heads 101*y*, 101*m*, 101*c*, and 101*k* to eject ink droplets of yellow (Y), magenta (M), cyan (C), and black (K). Alternatively, the image forming apparatus may be a serial-type image forming apparatus in which such a recording head unit is mounted on a movable carriage.

The conveyance belt 102 is an endless belt looped between a conveyance roller 121 and a tension roller 122 so as to circulate in a belt conveyance direction indicated by an arrow BCD illustrated in FIG. 1. The sheet 100 may be retained on the conveyance belt 102 by electrostatic attraction, air aspiration, or any other method. For example, the sheet 100 may be conveyed by a conveyance unit including a pair of rollers.

From a stack of sheets 100 stored in the sheet feed tray 103, the sheet 100 is separated by a pick-up roller 131 and fed by a pair of transport rollers 132 to a pair of registration rollers 133 via a first transport passage 135*a*. The pair of registration rollers 133 feeds the sheet 100 to the treatment-liquid application device 200, and the treatment-liquid application device 200 applies treatment liquid to the sheet 100. The sheet 100 applied with treatment liquid is fed by a pair of transport rollers 134 onto the conveyance belt 102 via a second transport passage 135*b*. Thus, the sheet 100 is retained on the conveyance belt 102.

The sheet 100 is conveyed by the circulation of the conveyance belt 102 to a position below the recording head unit 101. The recording head unit 101 ejects droplets of respective color inks to form a desired image on the sheet 100. The sheet 100 with the image formed is discharged to an output tray 104.

As illustrated in FIG. 1, the treatment-liquid application device 200 includes, for example, a treatment-liquid container 202 to store treatment liquid 201, a pump 203 to deliver with pressure the treatment liquid 201 from the treatment-liquid container 202, an applicator 208 to apply to the sheet 100 the treatment liquid 201 delivered by the pump 203 via a supply channel 204, a discharge pump 252 and a discharge channel 253 to collect and discharge the treatment liquid 201 from the applicator 208, and a waste-liquid tank 250 to store waste liquid 251 including the treatment liquid 201 discharged from the applicator 208.

In this exemplary embodiment, the treatment liquid 201 is a modifier applied to a surface of the sheet 100 to modify the surface of the sheet 100. For example, the treatment liquid 201 may be a fixing agent (setting agent) that is uniformly applied over the sheet 100 before image formation to cause the moisture of ink to promptly penetrate into the sheet 100, increase the viscosity of color components, and speed up drying of ink, thus preventing feathering, bleeding, and/or offset of ink and enhancing the productivity (e.g., the number of image outputs per unit time).

Regarding the composition, for example, the treatment liquid 201 may be a solution containing a surface acting agent (for example, an anionic, cationic, or nonionic agent or a mixed agent including two or more of the foregoing types), a cellulosic material (e.g., hydroxypropyl cellulose) for facilitating the penetration of moisture, and a base material such as talc powder. Further, the solution may contain fine particles.

Figure 2:
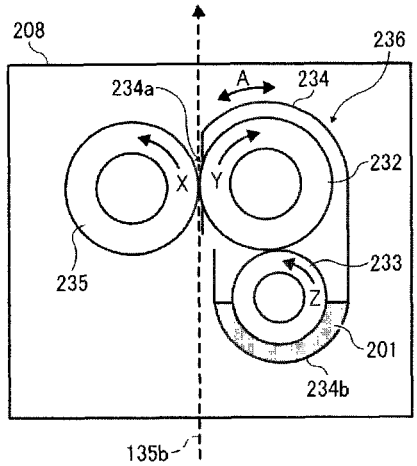
FIG. 2 is a schematic side view of an applicator of a treatment-liquid application device in application state in the first exemplary embodiment.
Figure 3:
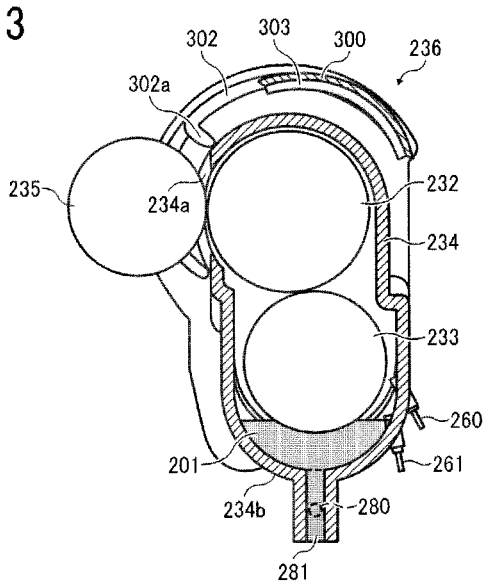
FIG. 3 is a cross-sectional side view of the applicator of FIG. 2 in application state.
Figure 4:
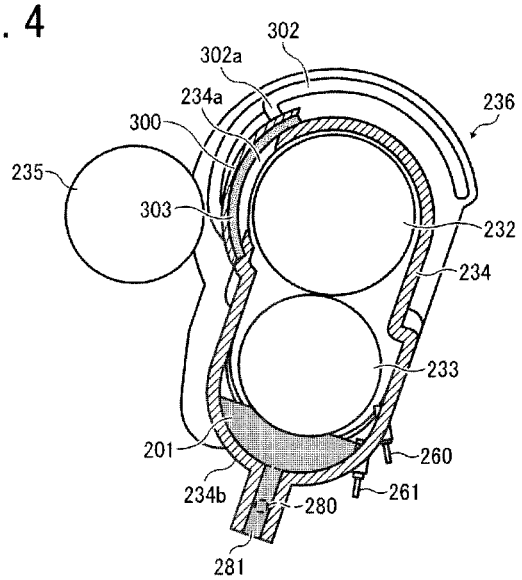
FIG. 4 is a cross-sectional side view of the applicator of FIG. 2 in standby state.

Next, the applicator 208 of the treatment-liquid application device 200 according to this exemplary embodiment is described in more details with reference to FIGS. 2 to 4.

FIG. 2 is a schematic side view of the applicator. FIG. 3 is a cross-sectional side view of the applicator in application state (shutter-opened state). FIG. 4 is a cross-sectional side view of the applicator in standby state (shutter-closed state).

The application unit 208 includes a conveyance roller 235, an application roller 232, a squeeze roller 233, and a housing member 234. The conveyance roller 235 conveys the sheet 100 and the application roller 232 is disposed opposing the conveyance roller 235 to apply the treatment liquid 201 onto the sheet 100. The squeeze roller 233 supplies the treatment liquid 201 onto the application roller 232 and spreads the treatment liquid 201 to form a thin layer (film) of the treatment liquid 201 on the application roller 232. The housing member 234 has an opening 234*a* to contact the application roller 232 with the conveyance roller 235 through, retains the application roller 232 and the squeeze roller 233 inside, and is capable of storing the treatment liquid 201 inside. The conveyance roller 235, the application roller 232, and the squeeze roller 233 rotate in the directions indicated by arrows X, Y, and Z, respectively.

As described above, by covering the application roller 232 and the squeeze roller 233 with the housing member 234, the application roller 232 and the squeeze roller 233 are not exposed to ambient air, thus reducing evaporation of the treatment liquid 201 on the application roller 232 and the squeeze roller 233. In addition, because the treatment liquid 201 is stored within the housing member 234, the interior of the housing member 234 can be maintained in saturation by slight evaporation of the treatment liquid stored in the housing member 234, thus minimizing evaporation of the treatment liquid 201 on the application roller 232 and the squeeze roller 233.

The application roller 232 contacts the conveyance roller 235 at a certain level of pressure, and the squeeze roller 233 contacts the application roller 232.

The housing member 234 is rotatable while retaining the application roller 232 and the squeeze roller 233 inside. In other words, the application roller 232, the squeeze roller 233, and the housing member 234 that serves as both a treatment-liquid tray and a roller cover are integrated as a single application unit 236. The application unit 236 is rotatable (movable) in a direction indicated by an arrow A illustrated in FIG. 2 between a state (application state or application position) illustrated in FIG. 3 and a state (standby or non-application state or standby or non-application position) illustrated in FIG. 4.

As illustrated in FIGS. 3 and 4, an inner circumferential surface (inner wall surface) of the housing member 234 partially has a shape similar to a portion of an outer circumferential surface of the application roller 232 and a portion of an outer circumferential surface of the squeeze roller 233. Of a clearance between the inner circumferential surface of the housing member 234 and the outer circumferential surface of the squeeze roller 233, a portion (so-called "pan", hereinafter "storage portion") 234*b* to store the treatment liquid 201 has a size greater than any other portion of the clearance.

As described above, the inner circumferential surface of the housing member 234 has a shape similar to the outer circumferential surface of each of the application roller 232 and the squeeze roller 233. Such a configuration reduces the size of the clearance between the inner circumferential surface of the housing member 234 and the outer circumferential surface of each of the application roller 232 and the squeeze roller 233. As a result, because the amount of air within the housing member 234 is reduced, the interior of the housing member 234 can reach a saturated vapor amount by slight evaporation of the treatment liquid 201, thus minimizing drying of the application roller 232 and the squeeze roller 233.

The housing member 234 also has a supply port 280 to supply the treatment liquid 201 into the housing member 234 through and a discharge port 281 to discharge the treatment liquid 201 from the housing member 234. The supply port 280 is formed in a lateral orientation, and the discharge port 281 is disposed at a position lower than the supply port 280. Such a configuration facilitates discharge of foreign substances, such as paper dust, in the storage portion 234*b* from the discharge port 281 while preventing the foreign substances from moving into the supply port 280. As detectors to detect the treatment liquid 201, the housing member 234 has a full-state sensor to detect a full state of the treatment liquid 201 and an end-state sensor 261 to detect an end-state of the treatment liquid 201.

The housing member 234 has a shutter member 300 having a cross section of an arc shape similar to the shape of the outer circumference of the application roller 232 to open and close the opening 234*a*. The shutter member 300 is guided along a guide groove 302 of the housing member 234 to move along the outer circumference of the housing member 234 between an open position (shutter open position) illustrated in FIG. 3 and a closed position (shutter closed position) illustrated in FIG. 4.

The guide groove 302 of the housing member 234 has a groove portion to separate the shutter member 300 from the outer circumferential surface of the housing member 234 at the shutter open position and move the shutter member 300 to the shutter closed position toward the outer circumferential surface of the housing member 234.

On the inner circumferential surface of the shutter member 300 is disposed a sealing member 303 serving as an elastically deformable member to firmly contact the inner circumferential surface of the shutter member 300 with the outer circumferential surface of the housing member 234. When the treatment liquid 201 is not applied, the shutter member 300 having the above-described configuration is moved to the shutter closed position to enhance the sealed state of the housing member 234, thus minimizing drying of the treatment liquid 201 on the application roller 232 and the squeeze roller 233.

Figure 5:
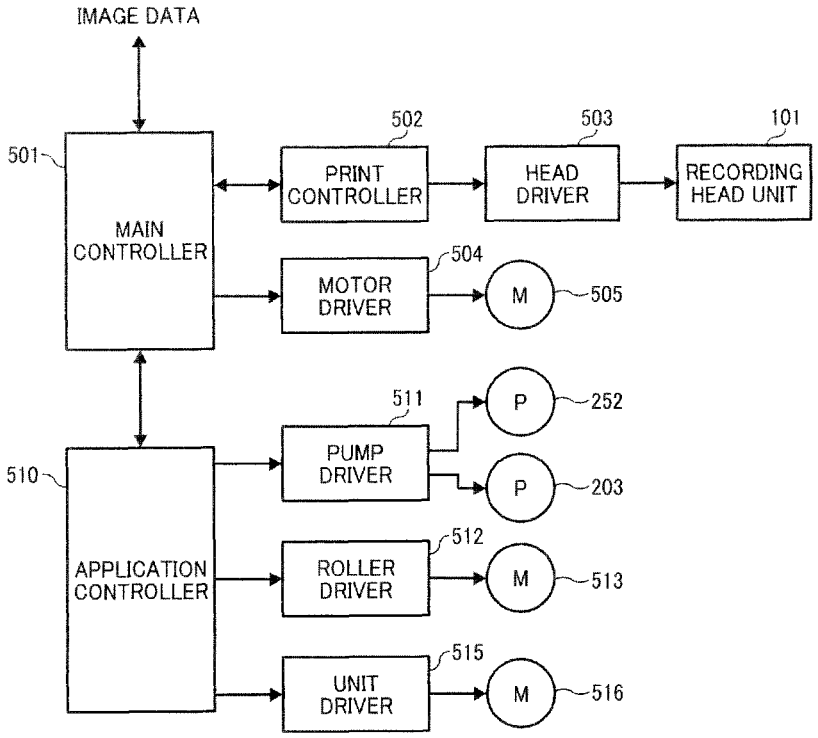
FIG. 5 is a block diagram of a control unit of the image forming apparatus.

Next, a control unit of the image forming apparatus is described with reference to FIG. 5.

A main controller 501 is actualized by a microcomputer including a central processing unit (CPU), a read only memory (ROM), a random access memory (RAM), input/output (I/O), and so on. The main controller 501 performs processing on received image data and transfers the processed image data to a print controller 502. The print controller 502 drives the recording head unit 101 via a head driver 503 so as to eject liquid droplets in accordance with the image data. The main controller 501 drives a conveyance motor 505 via a motor driver 504 to circulate the conveyance belt 102 to convey a recording medium (sheet) 100.

An application controller 510 controls components of the treatment-liquid application device 200. The application controller 510 receives an application request from the main controller 501 and controls application of the treatment liquid. At this time, the application controller 510 drives the pump 203 and the discharge pump 252 via the pump driving unit 511, drives a motor 513 via a roller driver 512 so as to rotate the application roller 232 and the squeeze roller 233, and drives a motor 516 via a unit driver 515 so as to rotate (pivot) the application unit 236.

As for the opening and closing of the shutter member 300, when the application unit 236 moves to the application position to contact the application roller 232 with the conveyance roller 235, the shutter member 300 moves to the open position illustrated in FIG. 3 in conjunction with rotation of the application unit 236 via an interlock mechanism (device). By contrast, when the application unit 236 moves to the non-application position to separate the application roller 232 from the conveyance roller 235, the shutter member 300 moves to the closed position illustrated in FIG. 4.

Next, operation of the treatment-liquid application device having the above-described configuration is described with reference to FIGS. 6 and 7.

Figure 6:
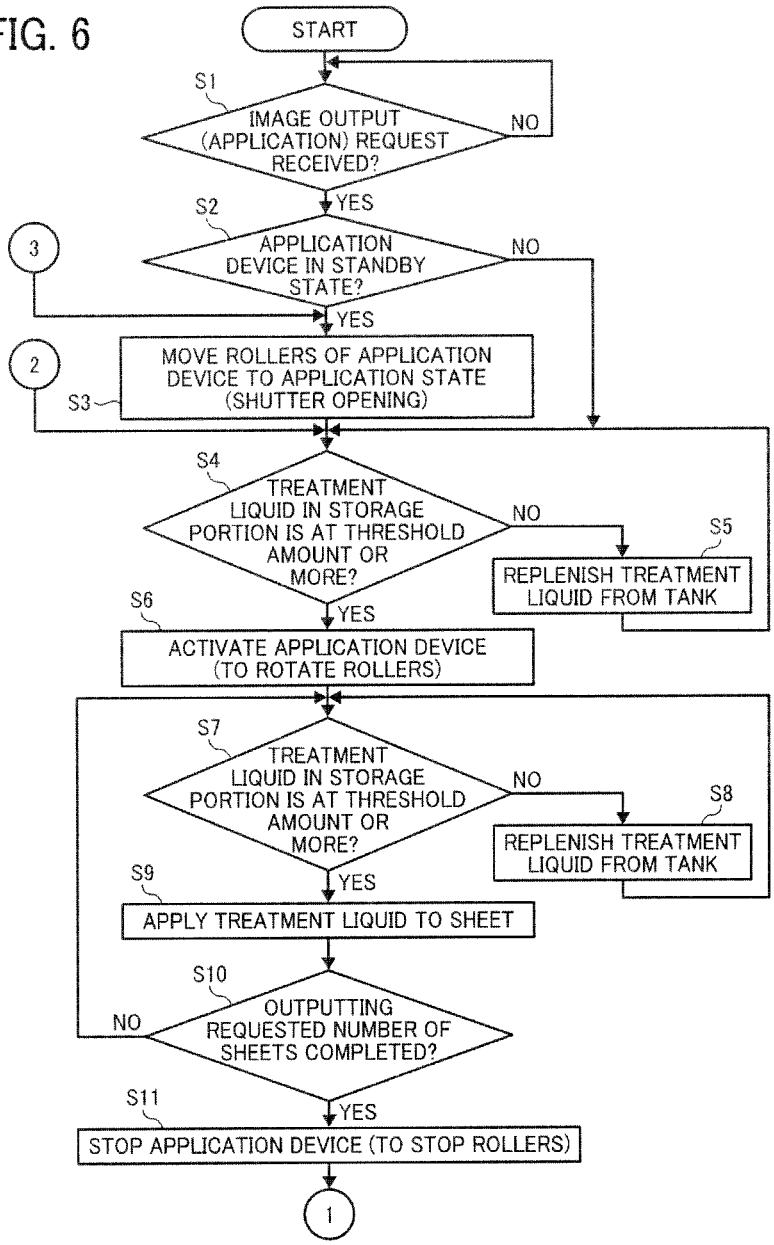
FIG. 6 is a flowchart of a procedure of operation of the treatment-liquid application device.

In FIG. 6, when receiving an image output (application) request (YES at S1), at S2 it is determined whether the applicator 208 of the treatment-liquid application device 200 is in standby (non-application) state. If the applicator 208 is in standby state (YES at S2), at S3 the application unit 236 is rotated to move the application roller 232 and the squeeze roller 233 to the positions of the application state (illustrated in FIG. 3). In conjunction with the rotation of the application unit 236 to the application state, the shutter member 300 moves to the open position to open the opening 234*a* of the housing member 234. As a result, with the shutter member 300 being open, the application roller 232 contacts the conveyance roller 235.

At S4, it is determined whether the treatment liquid 201 is at a threshold amount or more in the storage portion 234*b* of the housing member 234. If the treatment liquid 201 is less than the threshold amount in the storage portion 234*b* of the housing member 234 (NO at S4), at S5 the pump 203 is driven to supply (replenish) the treatment liquid 201 from the treatment-liquid container 202 (referred to as "tank" in drawings) to the storage portion 234*b* until the treatment liquid 201 reaches the threshold amount.

If the treatment liquid 201 is at the threshold amount or more or replenished to the threshold amount (YES at S4) in the storage portion 234*b* of the housing member 234, at S6 the treatment-liquid application device 200 is activated to rotate the squeeze roller 233 and the application roller 232 of the applicator 208.

At S7, it is determined whether the treatment liquid 201 is at a threshold amount or more in the storage portion 234*b* of the housing member 234. If the treatment liquid 201 is less than the threshold amount (NO at S7), at S8 the pump 203 is driven to supply (replenish) the treatment liquid 201 from the treatment-liquid container 202 to the storage portion 234*b* to retain the treatment liquid 201 at the threshold amount or more in the storage portion 234*b*. At S9, the treatment liquid 201 is applied to the sheet 100.

Replenishment of the treatment liquid 201 at S8 and application of the treatment liquid 201 at S9 are repeated until output of the requested number of sheets has been completed. If the output of the requested number of sheets has been completed (YES at S10), at S11 the application device 200 is stopped to stop rotation of the squeeze roller 233 and the application roller 232.

Figure 7:
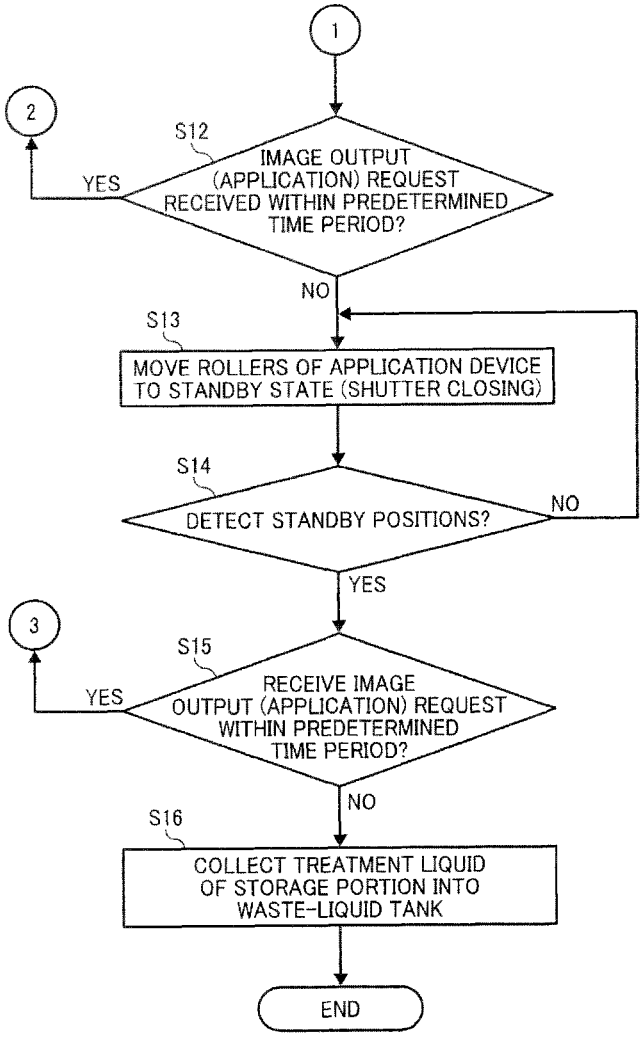
FIG. 7 is a flowchart of a procedure subsequent to the procedure illustrated in FIG. 6.

As illustrated in FIG. 7, if another image output (application) request is received within a predetermined period of time (YES at S12), the above-described S4 and subsequent steps are repeated. By contrast, if another image output (application) request is not received within a predetermined period of time (NO at S12), at S13 the application unit 236 is rotated to move the application roller 232 and the squeeze roller 233 to the positions of the standby state. At this time, in conjunction with the rotation of the application unit 236 to the standby state, the shutter member 300 moves to the closed position to close the opening 234*a*. Such a configuration can minimize drying of the treatment liquid 201 caused by, e.g., evaporation of moisture of the treatment liquid 201 in the housing member 234.

If still another image output (application) request is received within a predetermined period of time (YES at S15), the application roller 232 and the squeeze roller 233 are moved to the positions of the application state and the above-described S3 and subsequent steps are repeated.

By contrast, if still another image output (application) request is not received within a predetermined period of time (NO at S15), at S16 the treatment liquid 201 in the housing member 234 is collected to the waste-liquid tank 250. At this time, the discharge pump 252 serving as a pressure control device discharges the treatment liquid 201 to the waste-liquid tank 250 with the shutter member 300 being at the closed position. As a result, the internal pressure of the housing member 234 is reduced, thus reliably maintaining air tightness of the housing member 234 with the shutter member 300.

As described above, the treatment-liquid application device includes the conveyance roller to convey a recording medium, the squeeze roller to spread a treatment liquid to from a thin film of the treatment liquid on the application roller, and a housing member to retain the application roller and the squeeze roller inside and cover the outer circumferential surfaces of the application roller and the squeeze roller. The housing member has the opening to contact the application roller with the conveyance roller through the opening, includes the storage portion to store the treatment liquid, and is rotatable while retaining the application roller and the squeeze roller within the housing member. Such a configuration allows the application roller and the squeeze roller to be constantly covered together the treatment liquid, thus minimizing evaporation of the treatment liquid from the application roller and the squeeze roller. Thus, the above-described configuration can shorten the start-up time of treatment-liquid application even after a long time stop.

As described above, in this exemplary embodiment, the shutter member 300 moves in conjunction with the rotation of the housing member 234. Alternatively, for example, a driving device movable regardless of the rotation of the housing member 234 may be employed to open and close the shutter member. The application roller 232 and the squeeze roller 233 are disposed within the housing member 234, which tends to reduce the ease of maintenance of the rollers. Hence, in a case in which such a driving device for opening and closing the shutter member is employed, the shutter member 300 can be opened with the application unit 236 rotated to the standby position, thus allowing an operator to perform maintenance work, such as cleaning of the application roller 232, through the opening 234*a*.

At this time, the air tightness of the housing member 234 is released. Hence, in this state, the treatment liquid is supplied into the housing member 234 through the supply port 280 so that the squeeze roller 233 is fully immersed in the treatment liquid 201. Then, with the squeeze roller 233 being fully immersed in the treatment liquid 201, the squeeze roller 233 is closed, thus preventing drying of the squeeze roller 233 even over a long time stop.

Next, a second exemplary embodiment of the present disclosure is described with reference to FIGS. 8 and 9.

Figure 8:
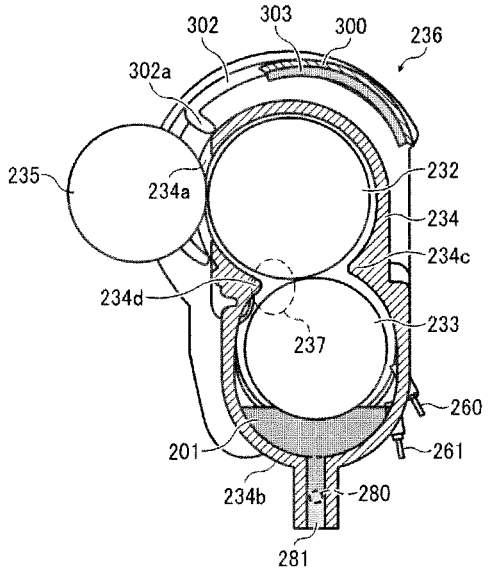
FIG. 8 is a cross-sectional side view of an applicator in application state in a second exemplary embodiment.
Figure 9:
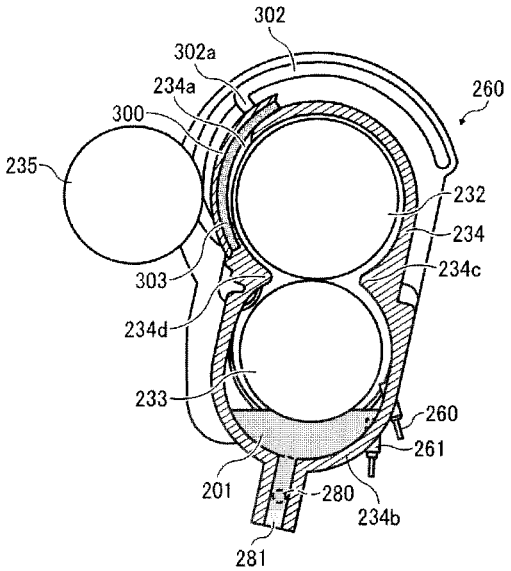
FIG. 9 is a cross-sectional side view of the applicator of FIG. 8 in standby state.

FIG. 8 is a cross-sectional side view of an applicator according to this exemplary embodiment in an application state. FIG. 9 is a cross-sectional side view of the applicator of FIG. 8 in a standby state.

In this exemplary embodiment, near a contact portion 237 that the application roller 232 contacts the squeeze roller 233, the inner circumferential surface (inner wall surface) of the housing member 234 has convex portions 234*c* and 234*d* of shapes similar to an outline shape of the contact portion 237 between the application roller 232 and the squeeze roller 233.

In this configuration, the amount of air within the housing member 234 is less than that of the above-described first exemplary embodiment. As a result, a smaller amount of evaporation allows the interior of the housing member 234 to reach the saturated vapor amount, thus preventing drying of the treatment liquid 201.

Next, a third exemplary embodiment of the present disclosure is described with reference to FIGS. 10 to 24.

Figure 10:
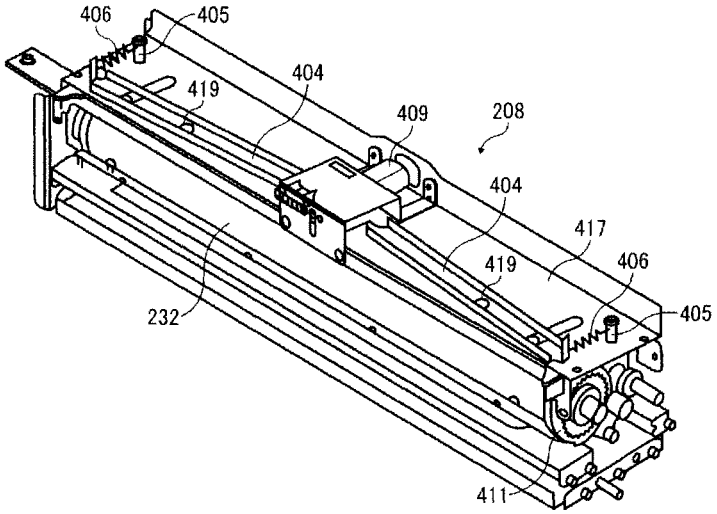
FIG. 10 is a perspective view of an applicator in standby state (shutter closed state) in a third exemplary embodiment.
Figure 11:
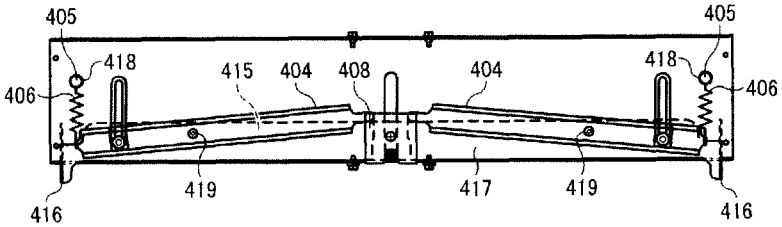
FIG. 11 is a plan view of the applicator of FIG. 10.
Figure 12:
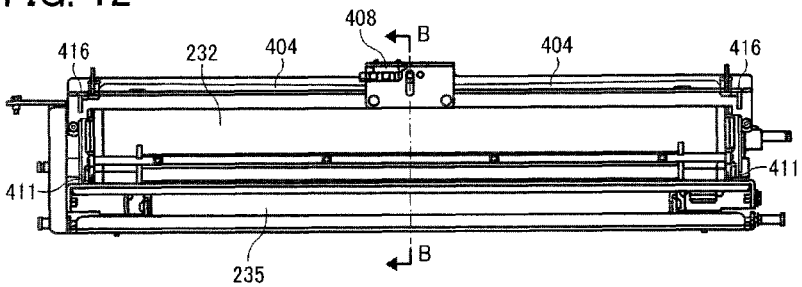
FIG. 12 is a front view of the applicator of FIG. 10.
Figure 13:
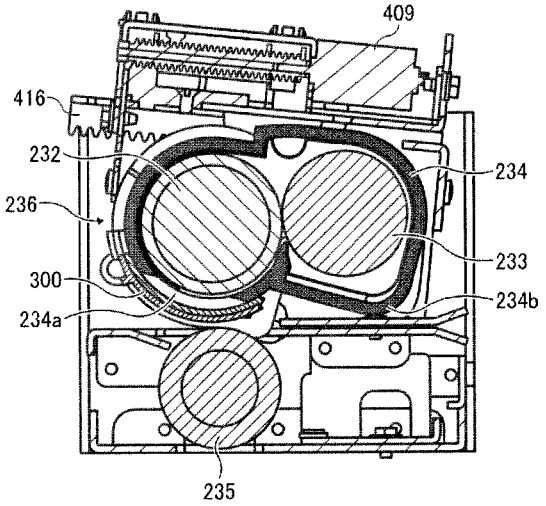
FIG. 13 is a cross-sectional view of the applicator cut along line B-B in FIG. 12.
Figure 14:
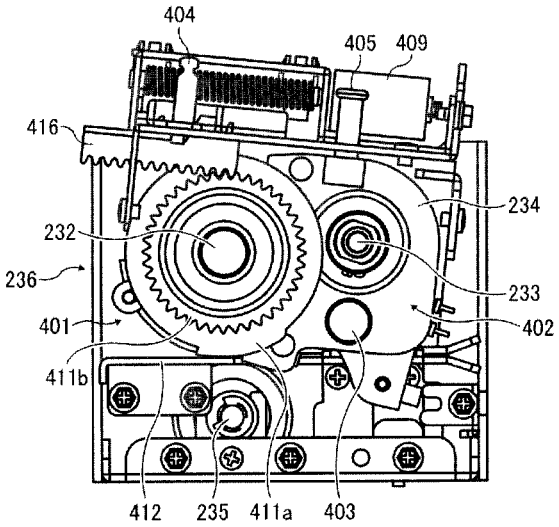
FIG. 14 is a side view of the applicator of FIG. 10.
Figure 15:
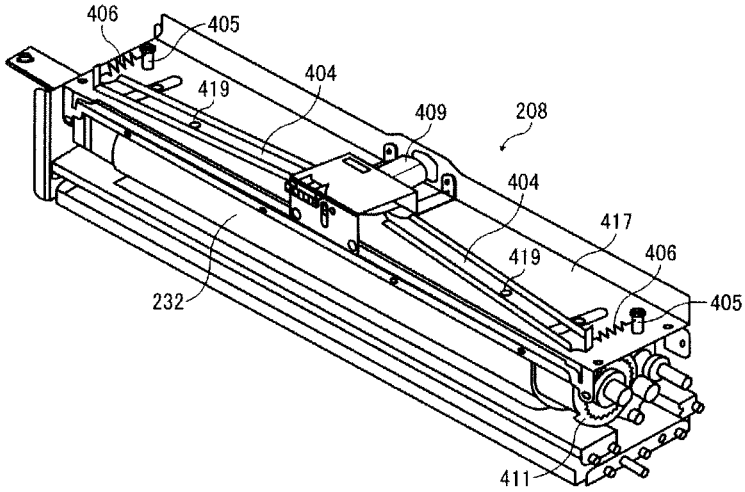
FIG. 15 is a perspective view of the applicator in shutter opening operation in the third exemplary embodiment.

FIG. 10 is a perspective view of an applicator according to this exemplary embodiment in a standby state (shutter closed state). FIG. 11 is a plan view of the applicator illustrated in FIG. 10. FIG. 12 is a front view of the applicator illustrated in FIG. 10. FIG. 13 is a cross-sectional view of the applicator illustrated in FIG. 10. FIG. 14 is a side view of the applicator illustrated in FIG. 10. FIGS. 15 to 19 show shutter open operation of the application unit corresponding to FIGS. 10 to 14, respectively. FIGS. 20 to 24 show an application state of the application unit corresponding to FIGS. 10 to 14, respectively.

In this exemplary embodiment, the applicator 208 has a configuration of horizontal arrangement (vertical application) in which the application roller 232 and the conveyance roller 235 are horizontally disposed so that the application roller 232 contacts the conveyance roller 235 from an upper side of the conveyance roller 235. Accordingly, the applicator 208 illustrated in FIG. 3 is rotated 90 degrees in the counterclockwise direction in FIGS. 13, 18, and 23.

Components relating to the application roller 232 are modularized as an application roller module 401, and components relating to the squeeze roller 233 are modularized as a squeeze roller module 402. The squeeze roller module 402 is rotatable around an application-roller pressure shaft 403 to adjust pressure of the squeeze roller 233 against the application roller 232 (see FIG. 14).

On the squeeze roller module 402 are disposed spring hooks 405 that protrude over a top board 417 through holes 418 of the top board 417 integrally formed with the application roller module 401. A clearance is disposed between each spring hook 405 and the corresponding hole 418 so that the spring hook 405 is movable in the hole 418. Spring pressure arms 404 are disposed above the top board 417, and each of application-and-squeeze pressure springs 406 is disposed between the spring hook 405 and one end of the spring pressure arm 404 to apply pressure between the application roller 232 and the squeeze roller 233.

At a middle portion of the applicator 208, the spring pressure arms 404 engage a camrack 408 moved by a motor 409. Because the spring pressure arms 404 are fixed to the top board 417 at fulcrums 419, one end of each spring pressure arm 404 mounting the camrack 408 moves in a direction opposite a direction in which the other end of each spring pressure arm 404 mounting the application-and-squeeze pressure spring 406.

A rack arm 415 is mounted to the camrack 408, and racks 416 are mounted to end portions of the rack arm 415.

Cam gears 411 are rotatably mounted at ends of the application roller module 401. Each of the cam gears 411 includes a cam 411*a* integrally formed with a gear 411*b*. The cams 411*a* of the cam gears 411 are disposed so as to be able to contact a main-unit fix portion 412. In a state in which the cams 411*a* are in contact with the main-unit fix portion 412, the cam gears 411 act as stopper to separate the application roller 232 from the conveyance roller 235. The gears 411*a* of the cam gears 411 engage the racks 416 and are connected to the shutter member 300.

In this exemplary embodiment, in the standby state (shutter closed state or non-application state), as illustrated in FIGS. 10 and 14, the application-and-squeeze pressure springs 406 are contracted so that the application roller 232 contacts the squeeze roller 233 at a relatively small pressure. The application unit 236 is lifted by the cams 411*a* of the cam gears 411 contacting the main-unit fix portion 412. As a result, the application roller 232 is separated from the conveyance roller 235. The opening 234*a* of the housing member 234 is closed with the shutter member 300 to seal the application unit 236.

Figure 16:
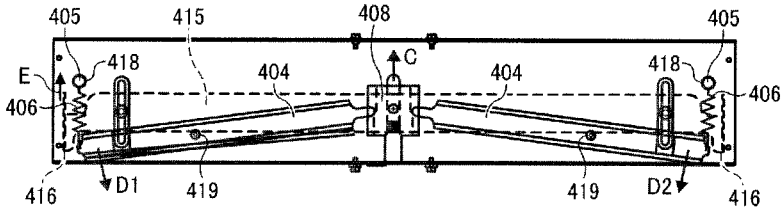
FIG. 16 is a plan view of the applicator in shutter opening operation illustrated in FIG. 15.
Figure 17:
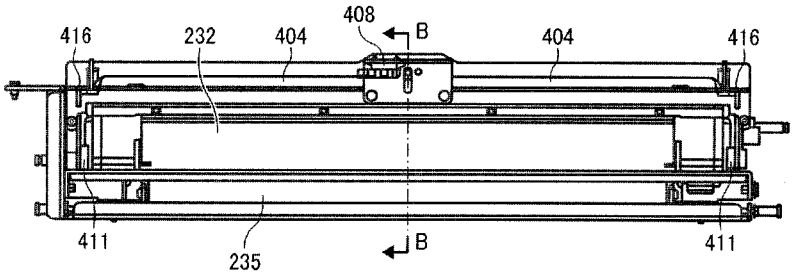
FIG. 17 is a front view of the applicator in shutter opening operation illustrated in FIG. 15.
Figure 18:
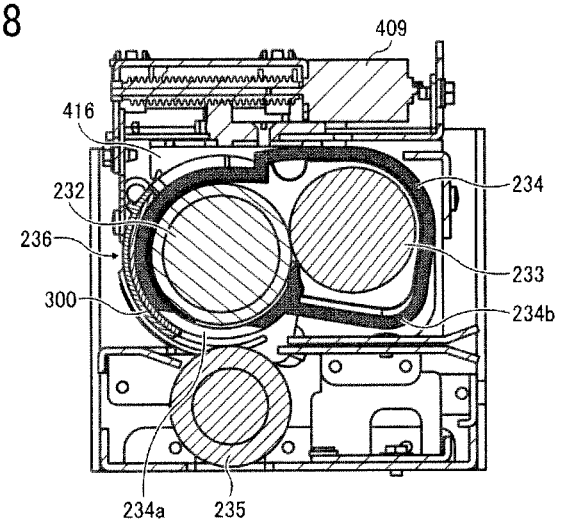
FIG. 18 is a cross-sectional view of the applicator cut along line C-C of FIG. 17.
Figure 19:
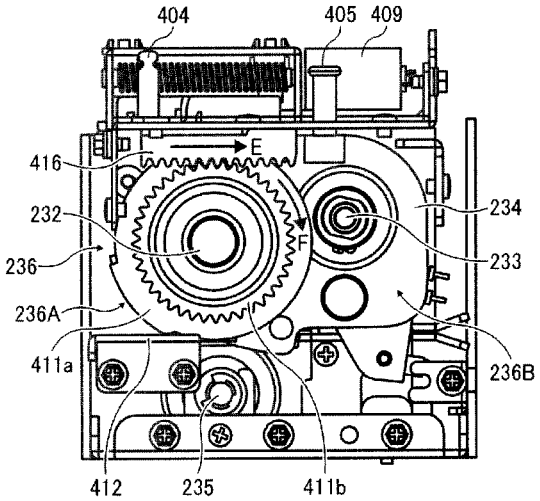
FIG. 19 is a side view of the applicator in shutter opening operation illustrated in FIG. 15.
Figure 20:
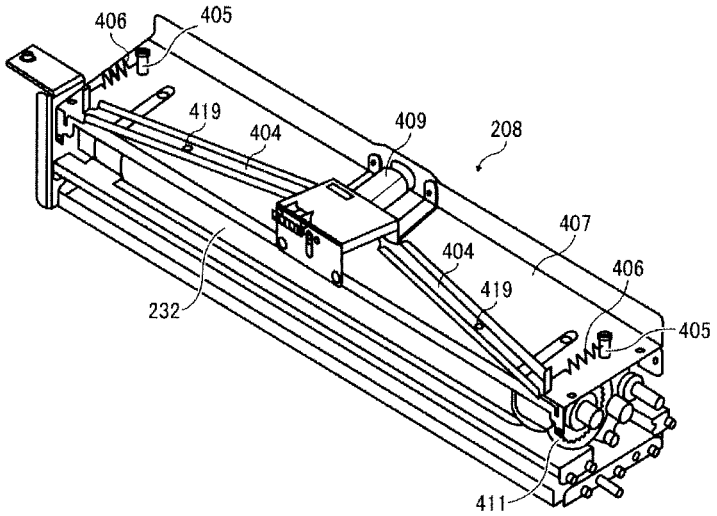
FIG. 20 is a perspective view of the applicator in application state in the third exemplary embodiment.
Figure 21:
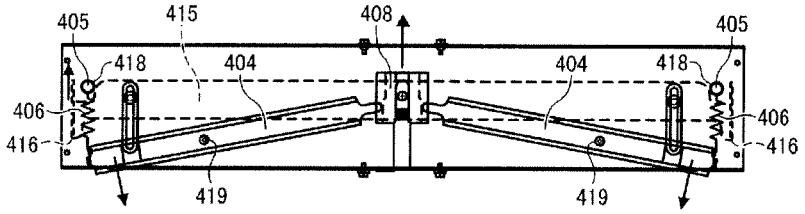
FIG. 21 is a plan view of the applicator in application state of FIG. 20.
Figure 22:
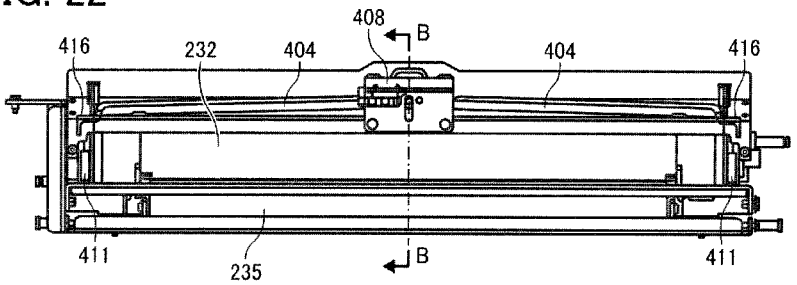
FIG. 22 is a front view of the applicator in application state of FIG. 20.
Figure 23:
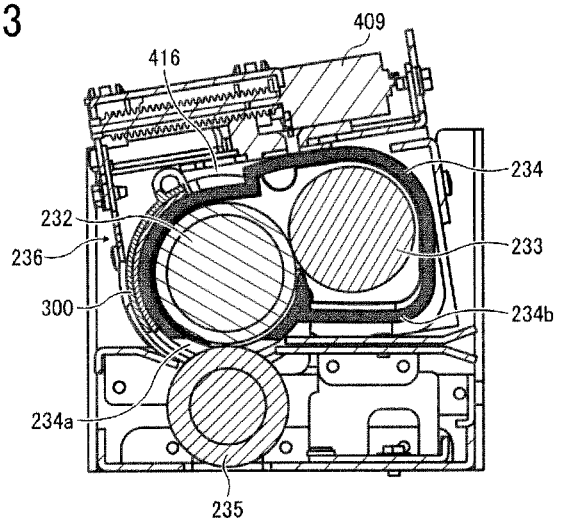
FIG. 23 is a cross-sectional view of the applicator cut along line D-D of FIG. 22.
Figure 24:
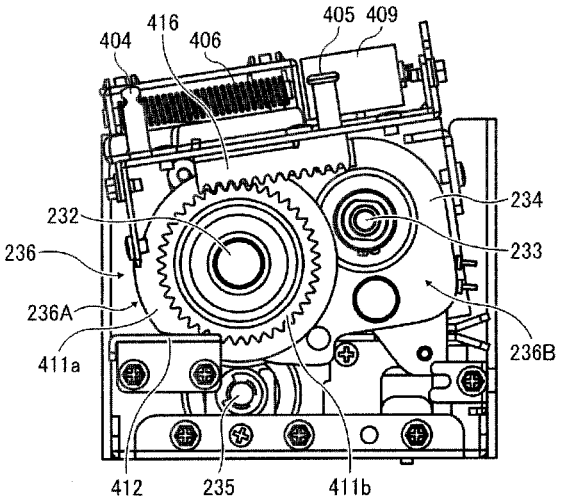
FIG. 24 is a side view of the applicator in application state of FIG. 20.

In this state, as illustrated in FIGS. 15 to 19, the motor 409 is driven to move the camrack 408 in a direction indicated by an arrow C in FIG. 16. When the camrack 408 moves, the spring pressure arms 404 swing in directions indicated by arrows D1 and D2 in FIG. 16 to extend the application-and-squeeze pressure springs 406. Because the spring hooks 405 are movable within the holes 418, the spring hooks 405 are moved in the directions D1 and D2 by the force of the application-and-squeeze pressure springs 406. As a result, the squeeze roller module 402 rotates around the application-roller press shaft 403, thus increasing the pressure acting between the application roller 232 and the squeeze roller 233.

When the camrack 408 further moves, the racks 416 move along with the rack arm 415 in a direction indicated by an arrow E in FIG. 16. As a result, the cam gears 411 rotate in a direction indicated by an arrow F to open the shutter member 300. Meanwhile, the cams 411*a* are separated from the main-unit fix portion 412 and the entire application unit 236 starts to rotate toward the conveyance roller 235. Preferably, a rotation shaft of the entire application unit 236 is disposed, for example, near a shaft of the squeeze roller 233.

When the motor 409 is continuously driven, as illustrated in FIGS. 20 to 24, the camrack 408 moves to a predetermined position. When the spring pressure arms 404 swing to certain positions, the application-and-squeeze pressure springs 406 are extended to certain positions to apply certain pressure between the application roller 232 and the squeeze roller 233. In addition, when the racks 416 move to certain positions, the shutter member 300 rotates to a certain position to open the opening 234*a*. Moreover, the cam gears 411 are separated from the main-unit fix portion 412, and the application roller 232 in the application unit 236 contacts the conveyance roller 235. At this time, a transfer pressure spring causes the application roller 232 to contact the conveyance roller 235 at a certain pressure.

Figure 26:
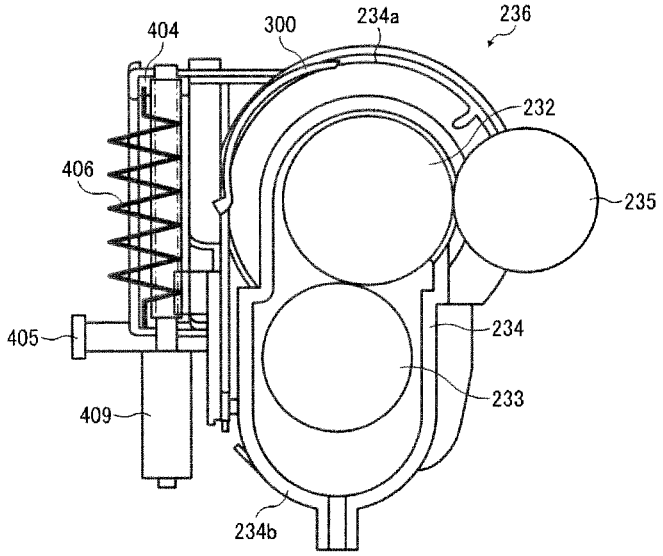
FIG. 26 is a cross-sectional side view of an applicator in application state in the fourth exemplary embodiment.
Figure 27:
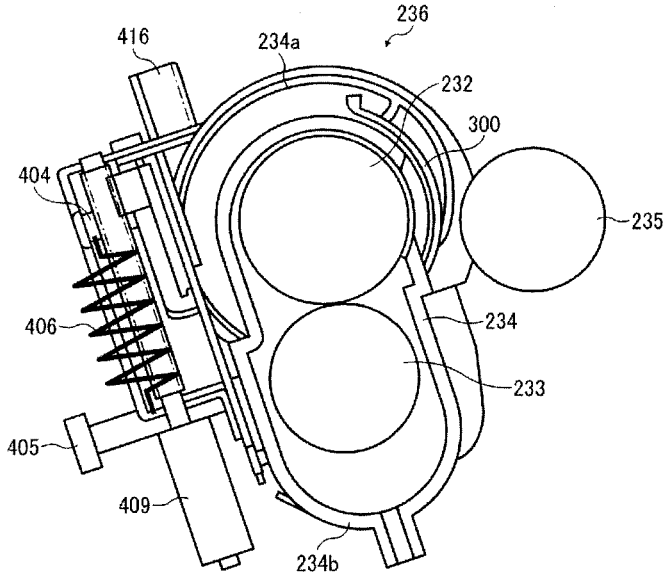
FIG. 27 is a cross-sectional side view of the applicator in standby state in the fourth exemplary embodiment.

Next, a fourth exemplary embodiment of the present disclosure is described with reference to FIGS. 25 to 27.

Figure 25:
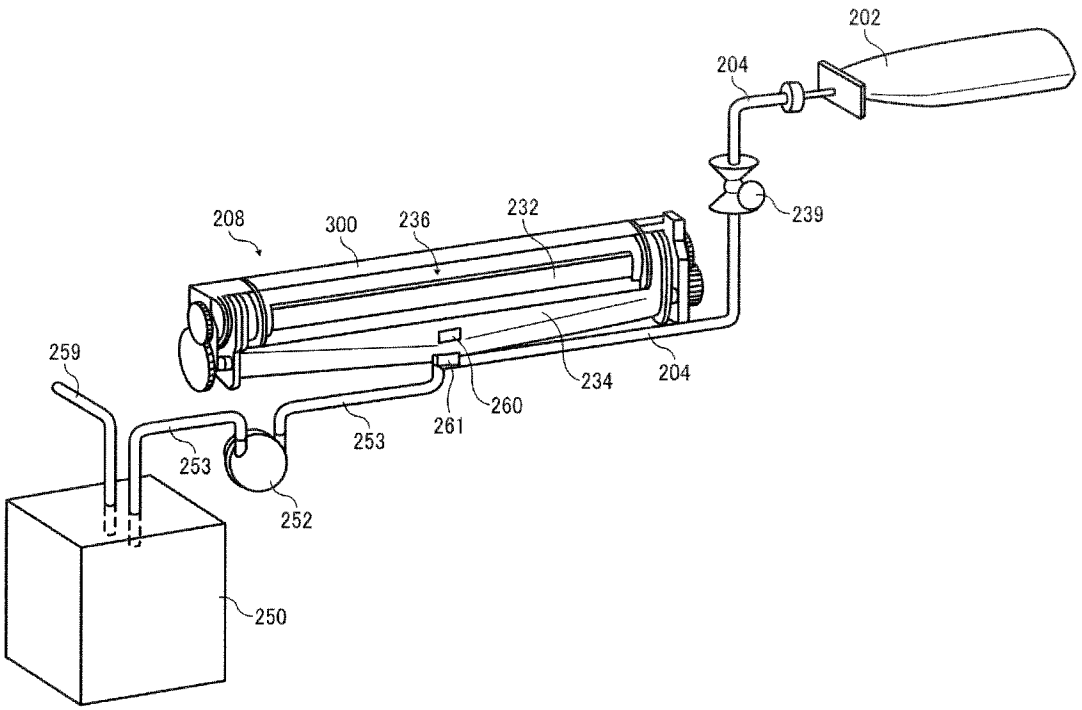
FIG. 25 is a perspective view of an application device according to a fourth exemplary embodiment.

FIG. 25 is a perspective view of a treatment-liquid application device according to this exemplary embodiment. FIG. 26 is a schematic side view of an application unit in this exemplary embodiment in an application state (shutter open state). FIG. 27 is a schematic side view of the application unit in a non-application state (shutter closed state).

As with the first exemplary embodiment, an applicator 208 in this exemplary embodiment has a configuration of vertical arrangement (lateral application) in which an application roller 232 contacts a conveyance roller 235 from a lateral side of the conveyance roller 235. In this exemplary embodiment, a treatment liquid 201 is supplied from an treatment-liquid container 202 according to a liquid supply method utilizing liquid-head difference, and an electromagnetic valve 239 is disposed at a supply channel 204. A waste-liquid tank 250 also acts as a tank for waste ink, and waste ink generated by, e.g., maintenance and recovery of the recording head unit 101 is discharged into the waste-liquid tank 250 through a waste ink tube 259.

In this exemplary embodiment, mechanisms for the rotation of the application unit 236 (contact and separation of the application roller) and the opening and closing of the shutter member are similar to those of the above-described third exemplary embodiment and descriptions thereof are omitted.

As described above, in this exemplary embodiment, the application roller 232 is arranged to contact against the conveyance roller 235 from a lateral side f the conveyance roller 235, thus allowing a storage portion 234*b* to have a large space to store the treatment liquid 201. In addition, the opening 234*a* is disposed at an upper portion of the application unit 236, thus preventing leakage of the treatment liquid 201 from the opening 234*a* due to, e.g., shaking of the application device. Thus, increased reliability of the treatment-liquid application device can be achieved.

In the above-described exemplary embodiments, the treatment-liquid application device applies a treatment liquid to a sheet before image formation. Alternatively, the treatment-liquid application device may apply a treatment liquid onto a sheet after image formation at a position downstream from the recording head unit in the sheet transport direction.

Although the image forming apparatus is described as liquid-ejection-type image forming apparatus in the above-described exemplary embodiment, the image forming apparatus may be, for example, an electrophotographic image forming apparatus. For example, the above-described treatment-liquid application device and method is also applicable to a fixing method and device or an image forming method and apparatus using a fixing liquid capable of quickly fixing fine particles (e.g., toner) containing resin on a recording medium (e.g., a sheet of paper) after application without disturbing the resin fine particles on the recording medium and of being applied at a slight amount so as not to left oily traces on the recording medium.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

an image forming unit to form an image on a recording medium; and a treatment-liquid application device to apply a treatment liquid to the recording medium, the treatment-liquid application device including:

a conveyance roller to convey the recording medium;

an application roller to apply the treatment liquid to the recording medium;

a squeeze roller to spread the treatment liquid on the application roller to form a thin layer of the treatment liquid on the application roller;

a housing member to retain the application roller and the squeeze roller within the housing member and cover outer circumferential surfaces of the application roller and the squeeze roller, the housing member having an opening to contact the application roller with the conveyance roller through the opening and a storage portion to store the treatment liquid, the housing member being rotatable while retaining the application roller and the conveyance roller within the housing member;

plural cam gears rotatably mounted to respective ends of the application roller, each cam gear amongst the plural cam gears comprising a gear and a cam integrally formed with the gear;

a rack configured to engage the gears of the cam gears and rotate the cam gears; and a fix portion disposed to contact the cam of the cam gear in a state in which the application roller is separated from the conveyance roller, wherein when the application roller applies the treatment liquid to the recording medium, the application roller transfers the thin layer of the treatment liquid, which was spread on the application roller by the squeeze roller, onto the recording medium with the application roller contacting the recording medium.

2. The image forming apparatus according to claim 1, wherein rotation of the housing member causes the application roller to contact and separate from the conveyance roller.

3. The image forming apparatus according to claim 1, wherein an inner circumferential surface of the housing member at least partially has a shape similar to a shape of an outer circumferential surface of the application roller.

4. The image forming apparatus according to claim 1, wherein a clearance between an inner circumferential surface of the housing member and an outer circumferential surface of the squeeze roller is greater in the storage portion than in any other area.

5. The image forming apparatus according to claim 1, further comprising a shutter member to open and close the opening of the housing member.

6. The image forming apparatus according to claim 5, further comprising a pressure control unit to reduce pressure within the housing member by extracting the treatment liquid from the housing member after the opening of the housing member is closed with the shutter member.

7. The image forming apparatus according to claim 1, wherein the rack is configured to slide in a direction tangential to a circumference of the cam gear, and when the rack is engaged with the gears of the cam gears, the tangential movement of the rack causes the cam gear to rotate and the cam gear to move to a position away from the fix portion, such that the application roller and the conveyance roller contact each other.

8. The image forming apparatus according to claim 1, wherein the application device comprises a shutter member configured to be movable between an open position and a closed position, wherein the shutter member is coupled to the cam gear, and rotation of the cam gear causes the shutter member to open and close the opening of the housing member.

9. The image forming apparatus according to claim 1, wherein the squeeze roller picks up the treatment liquid in the storage portion of the housing member and spreads the thin layer of the treatment liquid on the application roller, and the application roller does not contact the treatment liquid disposed in the storage portion.

10. A treatment-liquid application device for applying a treatment liquid to a recording medium before an image is to be formed on the recording medium, the treatment-liquid application device comprising:

a conveyance roller to convey the recording medium;

an application roller to apply the treatment liquid to the recording medium;

a squeeze roller to spread the treatment liquid on the application roller to form a thin layer of the treatment liquid on the application roller; and a housing member to retain the application roller and the squeeze roller within the housing member and cover outer circumferential surfaces of the application roller and the squeeze roller, the housing member having an opening to contact the application roller with the conveyance roller through the opening and a storage portion to store the treatment liquid, the housing member being rotatable while retaining the application roller and the conveyance roller within the housing member;

plural cam gears rotatably mounted to respective ends of the application roller, each cam gear amongst the plural cam gears comprising a gear and a cam integrally formed with the gear;

a rack configured to engage the gears of the cam gears and rotate the cam gears; and a fix portion disposed to contact the cam of the cam gear in a state in which the application roller is separated from the conveyance roller, wherein when the application roller applies the treatment liquid to the recording medium, the application roller transfers the thin layer of the treatment liquid, which was spread on the application roller by the squeeze roller onto the recording medium with the application roller contacting the recording medium.

11. The treatment-liquid application device according to claim 10, wherein the conveyance roller conveys the recording medium to output the recording medium bearing the treatment liquid applied thereto by the application roller, for an image to be formed on the recording medium bearing the treatment liquid, after the treatment liquid has been applied by the application roller to the recording medium.

* * * * *